United States Patent [19]

Archer et al.

[11] Patent Number: 4,781,813

[45] Date of Patent: Nov. 1, 1988

[54] METHOD AND APPARATUS FOR ASSURING PLATING UNIFORMITY

[75] Inventors: Timothy H. V. Archer; Richard Sutera, both of Centerville, Ohio

[73] Assignee: Burlington Industries, Inc., Greensboro, N.C.

[21] Appl. No.: 69,189

[22] Filed: Jul. 2, 1987

[51] Int. Cl.[4] ..... C25D 17/06

[52] U.S. Cl. ..... 204/297 W

[58] Field of Search ..... 204/297 W

[56] References Cited

U.S. PATENT DOCUMENTS

| | | | |
|---|---|---|---|
| 1,427,875 | 9/1922 | Weeks | 204/297 R |
| 2,118,957 | 5/1938 | Wagner | 204/297 W |
| 2,762,149 | 9/1956 | Mears | 156/40 |
| 2,891,898 | 6/1959 | MacLean | 204/297 W |
| 2,946,584 | 7/1960 | Edwards | 269/156 |
| 3,677,929 | 7/1972 | Young, Jr. | 204/286 |
| 4,395,613 | 7/1983 | Barr et al. | 219/69 E |
| 4,609,249 | 9/1986 | Hornack et al. | 339/263 E |

FOREIGN PATENT DOCUMENTS

| | | | |
|---|---|---|---|
| 872508 | 7/1961 | United Kingdom | 204/297 W |

OTHER PUBLICATIONS

"Wafer Chuck," Brunner, IBM Technical Disclosure Bulletin, vol. 17, No. 1, p. 84, Jun., 1974.

*Primary Examiner*—T. M. Tufariello

*Attorney, Agent, or Firm*—Nixon & Vanderhye

[57] ABSTRACT

A tensioning mechanism includes a frame pivotally carrying an arm at one end intermediate its length and carrying an arm fixed to the frame at its opposite end intermediate its length. Tension springs are disposed between the arms on one side of the frame and the ends of the arms on the opposite side of the frame releasably carry clamps for securing a substrate between the arms. When the substrate is clamped to the arms, the springs pivot the one arm to apply a tension to the substrate to ensure flatness and planarity of the substrate. The mechanism may then be disposed in an electrolytic bath for plating the substrate and hence defining locations for orifices to be formed in the substrate.

23 Claims, 3 Drawing Sheets

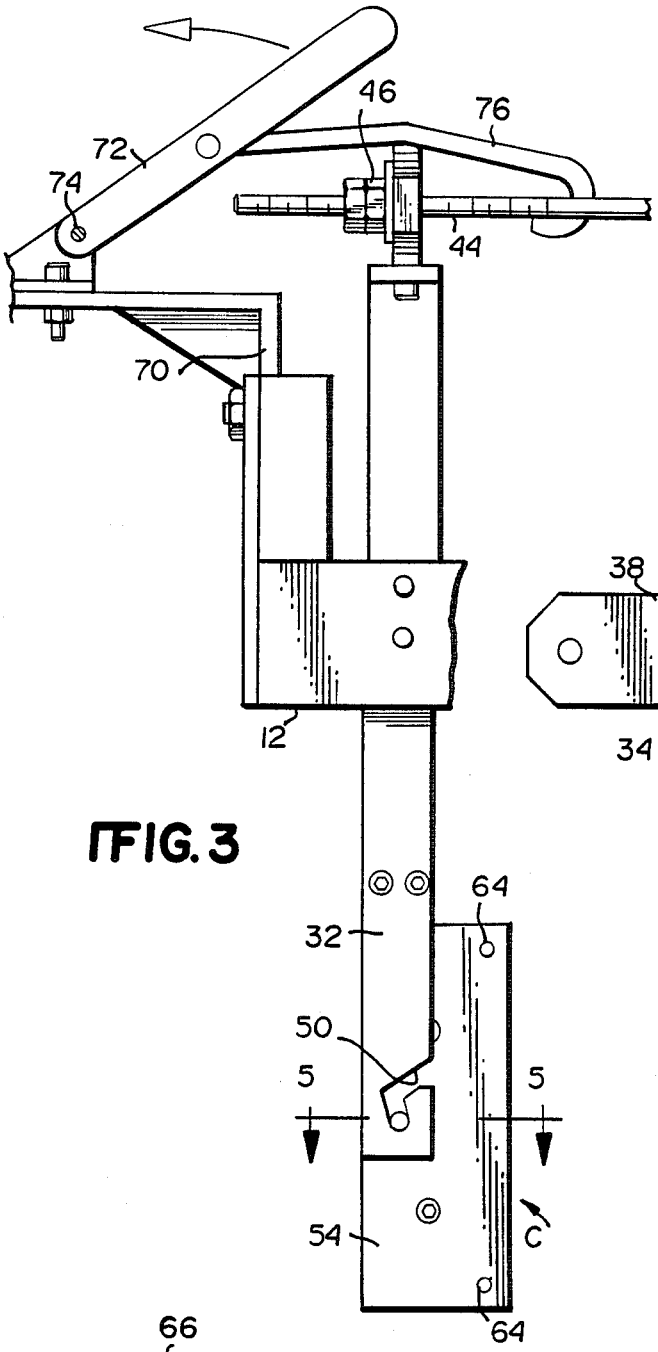
FIG. 3
FIG. 4
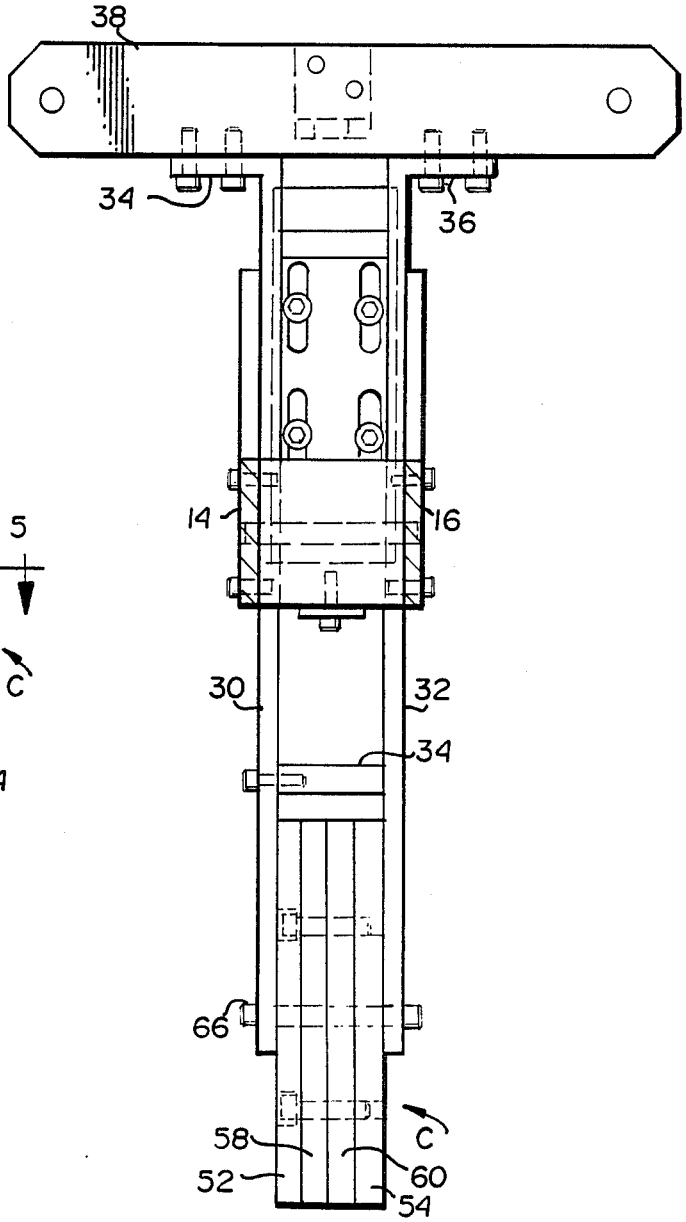
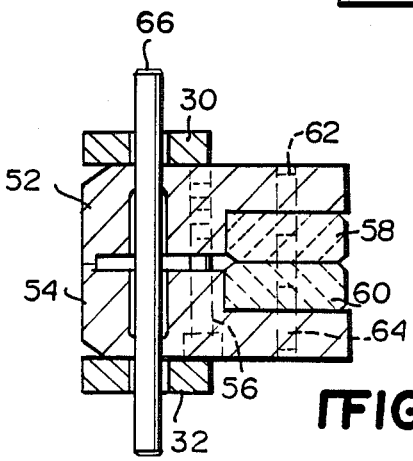
FIG. 5

METHOD AND APPARATUS FOR ASSURING PLATING UNIFORMITY

BACKGROUND AND SUMMARY OF THE INVENTION

The present invention relates to apparatus and methods for forming the orifice plate for a fluid-jet printing device and particularly to apparatus and methods for assuring planarity of the orifice plate when disposed in an electrolytic bath whereby orifices of uniform size and shape through the orifice plate may be obtained.

In fluid-jet printing technology, a linear array of fluid-jet orifices are formed in a substrate from which filaments of fluid issue to form a plurality of droplet streams for deposition on a substrate. Individually controllable electrostatic charging electrodes are disposed downstream of the orifice plate along the "drop formation" zone. In accordance with known principles of electrostatic conduction, these fluid filaments are provided an electrical charge opposite in polarity and related in magnitude to the electrical charge of the charging electrode. When the droplets separate from the filaments, the induced electrostatic charge is trapped on and in the droplets. The charged droplets then pass through a subsequent electrostatic field and are thereby deflected from a straight downward path toward a catcher structure. Uncharged droplets proceed along the straight path and are deposited upon the receiving substrate.

Recognizing that the size of the individual orifices through the orifice plate is extremely small, a number of different apparatus and methods for forming the orifice plate have been proposed in the past. One such method is disclosed in U.S. Pat. No. 4,528,070, issued July 9, 1985, of common assignee herewith, the disclosure of which is incorporated herein by reference thereto. In that process, a photomask is applied to a stainless steel substrate to form specific images which are resistant to plating in the subsequent nickel-phosphorus plating steps. After the nickel-phosphorus plating is complete, the photomask is removed and the plated stainless steel is exposed to hot ferric chloride, which dissolves the stainless steel in the areas of the photomask not covered by the nickel-phosphorus plating. The resulting apertures through the plated substrate serve as orifices in the orifice plate of a fluid-jet printing apparatus.

To assure that the fluid-jet droplets are formed regularly and precisely, it is important that the orifices formed in the orifice plate be as uniform in size and shape as possible. To achieve this uniformity, it is important that the coating, e.g., the nickel-phosphorus coating, is applied in as uniform and reproducible a manner as possible. In the electroplating process applying the nickel-phosphorus coating, the stainless steel substrate serves as a cathode in the electrolytic bath in which there is also disposed an anode. An electrical potential is applied across the anode/cathode and causes migration of ions to the cathode where they are reduced to nickel and phosphorus. The electrical field which causes the migration should be as uniform as possible across the area of the substrate to assure that the migration takes place uniformly toward the cathode surface. Additionally, the cathode should be as flat or planar as possible in order that the voltage over the surface being plated is as uniform as possible, thus assuring a uniform plating rate.

Uniformity of the electrical field and the voltage over the surface being plated is achieved by making the orifice plate substrate as flat as possible and as parallel as possible relative to a planar anode array. Minor deviations from such planarity and parallelism cause irregularities in the amount of electroplating nickel and phosphorus, resulting in non-uniformity in orifice size and shape. This uniformity has proven somewhat difficult to achieve in practice because the stainless steel orifice plate, which forms the cathode in the electrolytic bath, is quite thin. Also, orifice plates for use in fluid-jet printers for applying ink, chemicals, etc. to textile fabrics are on the order of 1.8 meters long and thus are subject to flexing, bending and twisting, rendering achievement of planarity and parallelism in the electrolytic bath exceedingly difficult.

In accordance with the present invention, there is provided apparatus for assuring the planarity of the orifice plate when in the electrolytic bath. To accomplish this, a tensioning mechanism for placing the cathode/substrate in tension during the electrolytic plating process is provided. Such apparatus includes an elongated frame mounting a pair of arms at opposite ends of the frame spaced one from the other a distance greater than the length of the cathode/substrate. One of the arms is pivoted intermediate its ends to the frame while the other arm is fixed intermediate its ends to the frame. Tension rods and springs extend between corresponding, e.g., upper, ends of the arms. The corresponding opposite, e.g., lower, ends of the arms are provided with a pair of spaced support elements which receive therebetween a pair of jaws for clamping the ends of the substrate. A pair of ceramic, electrical insulating, blocks are disposed between the jaws at each of the ends for grasping an end of the substrate whereby the substrate is electrically insulated from the tensioning mechanism. The jaws also mount a pin which is received in slots formed in the arms such that, when the substrate is tensioned between the arms, uniform tension is applied across the width of the substrate.

Mounted on the frame adjacent the upper end of the pivoted arm is a toggle or over-center lever. The lever may be used to rotate the arm against the bias of the tension spring and thereby locate the lower arm in position to receive the pin. It will be appreciated that, upon release of the lever, the springs bias the arm for rotation in a direction applying tension to the substrate. In this manner, the flatness or planarity of the substrate is assured.

It is important that the tension and hence the flatness and planarity of the substrate be maintained during the electroplating process. To avoid distortion or warpage of the tensioning mechanism when in the bath due to different temperature coefficients of expansion of various materials and to avoid the effects of the corrosive nature of the bath, the arms and the clamps, as well as the frame, are formed of titanium. The springs are formed of a different material, e.g., steel, inasmuch as they are not disposed in the bath.

Prior to inserting the tensioned substrate into the bath, a plurality of electrical connections are spot-welded along the length of the substrate adjacent an edge thereof. The electrical connections are connected to a current control device for regulating current flow along each connection and hence the amount of plating in the immediate area of the substrate about welded electrical connection. That is, the plating is a function of the applied current and the hole size through the orifice plate is a function of the thickness of the plating. The relative thinness of the desired coating is about 6/10 of 1/1000 of an inch and it is desired to control the thickness of the plating to 1% of the thickness. To obtain such high accuracy and resolution, it is necessary to first electrolytically plate a series of substrates and measure the thickness on each substrate in order to ascertain the proper current flow through the electrical connections to the substrate, which, in turn, determines the thickness of the coating applied in the electrolytic bath. Once the proper thickness is obtained, the current controller is set and orifice plates may then be formed. In this manner, consistency, uniformity and reproducibility is achieved and the tensioning mechanism of the present invention contributes to those ends by maintaining the flatness or planarity of the substrate during the electroplating process.

In accordance with a preferred embodiment of the present invention, there is provided apparatus for tensioning an elongated substrate for maintaining planarity thereof during an electroplating process to ensure substantially uniform plating, comprising a pair of means for gripping opposite end portions of the substrate, means connected to one of the gripping means for applying tension to the substrate and means for electrically isolating the tension applying means from the substrate.

In accordance with a further preferred embodiment of the present invention, there is provided an apparatus for tensioning an elongated substrate for maintaining planarity thereof during an electroplating process thereby to ensure substantially uniform plating of the substrate, the apparatus comprising an elongated frame having at least one arm pivotally carried by the frame at one end thereof, a pair of clamps, one of the clamps being carried by the one arm, with the other of the clamps being carried by the frame adjacent the opposite end thereof such that the clamps may grip the opposite ends of the substrate. Means are also provided for electrically isolating the one arm and the frame from the substrate when clamped between the arms, with additional means being carried by the frame for pivoting the one arm in a direction for applying tension to the substrate. Preferably, each clamp includes a pair of jaws between which are carried a pair of insulator blocks for straddling the end of the substrate, the insulator blocks being formed of a ceramic material for electrically insulating the substrate from the frame.

In accordance with a further aspect of the present invention there is provided a method for ensuring the planarity of an elongated substrate during an electroplating process and thereby ensuring substantially uniform plating, including the steps of clamping the opposite ends of a substrate in a frame, applying tension to one end of the clamped substrate to effect planarity thereof between its clamped ends and immersing the frame, while the substrate remains under tension, in an electrolytic bath to plate the substrate.

Accordingly, it is a primary object of the present invention to provide novel and improved apparatus and methods for ensuring the planarity or flatness of a substrate in an electrolytic bath whereby the substrate may form the orifice plate of a fluid-jet printing or applicator device.

These and further objects and advantages of the present invention will become more apparent upon reference to the following specification, appended claims and drawings.

BRIEF DESCRIPTION OF THE DRAWING FIGURES

FIG. 3 is an enlarged fragmentary side elevational view of an end of the tensioning mechanism illustrated in FIG. 1;

FIG. 4 is an end view of the tensioning mechanism of the present invention looking from left to right in FIG. 1;

FIG. 5 is a cross-sectional view thereof taken generally about on line 5—5 in FIG. 3;

DETAILED DESCRIPTION OF THE DRAWING FIGURES

Reference will now be made in detail to the present preferred embodiment of the invention, an example of which is illustrated in the accompanying drawings.

Figure 1:
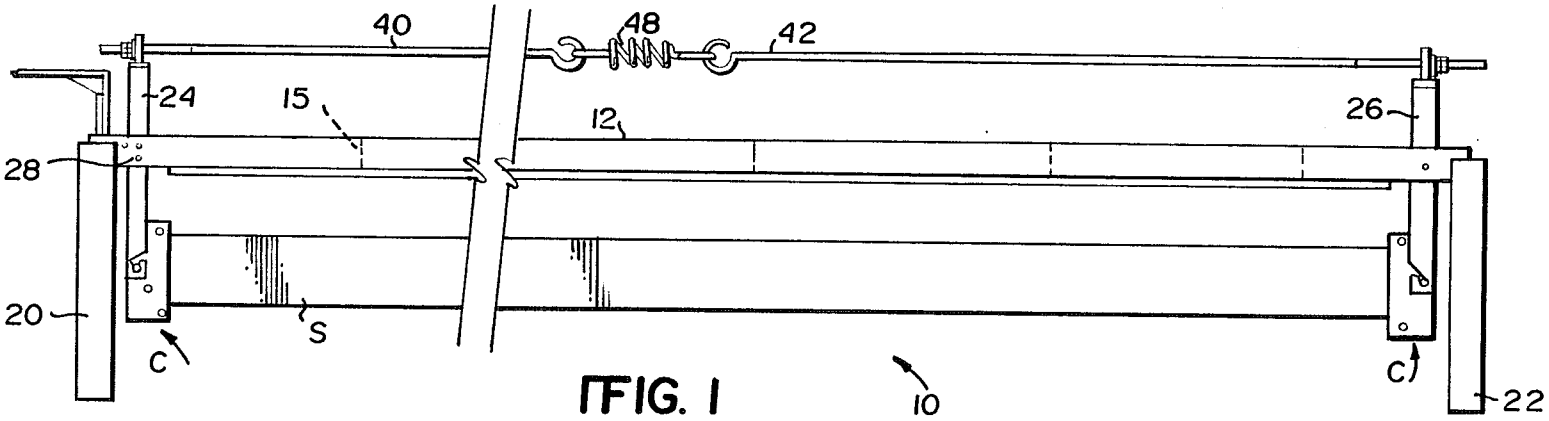
FIG. 1 is a side elevational view with parts broken out illustrating a tensioning mechanism constructed in accordance with the present invention.
Figure 2:
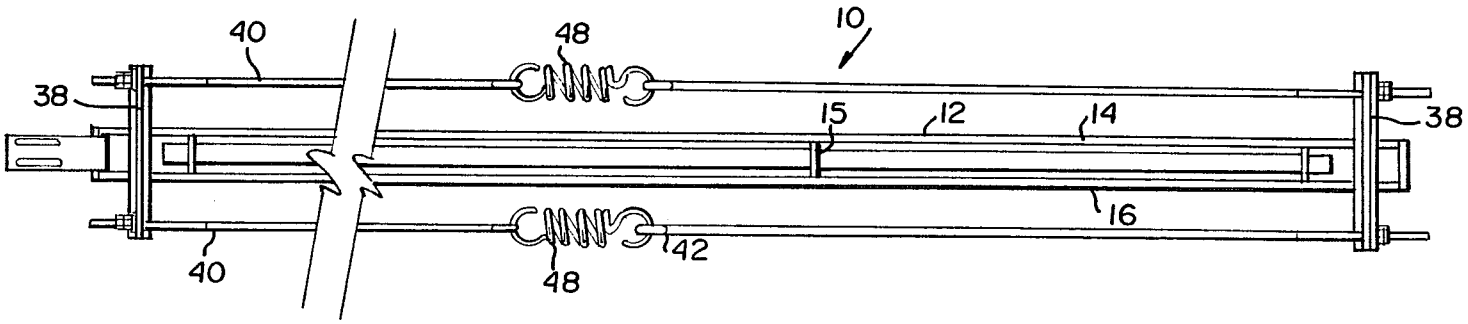
FIG. 2 is a top plan view thereof.

Referring now to the drawing figures, particularly to FIGS. 1 and 2, there is illustrated a tensioning mechanism constructed in accordance with the present invention and generally designated 10. Tensioning mechanism 10 includes an elongated frame 12 having a length in excess of the length of a substrate S, e.g., an elongated orifice plate for fluid-jet printing. Frame 12 is formed of a pair of laterally spaced, elongated side plates 14 and 16 secured one to the other by crosspieces 15 spaced longitudinally along frame 12 one from the other and bolted between side plates 14 and 16. Elongated frame 12 includes a bottom plate 18 bolted to crosspieces 15. As illustrated, the ends of frame 12 are disposed in the notched upper ends of a pair of end supports 20 and 22 and is removable from and portable relative to end supports 20 and 22.

A pair of arms 24 and 26, respectively, are mounted at opposite ends of frame 12. The arms are identical in construction one to the other except that arm 24 is pivotally carried by frame 12 for pivoting movement about an axis 28, whereas arm 26 is rigidly secured to frame 12. Each arm 24 and 26 includes a pair of laterally spaced elements 30 and 32 (FIG. 4) with suitable crosspieces 34 bolted therebetween. As best seen in FIG. 4, elements 30 and 32 terminate at their upper ends in laterally outwardly directed flanges 34 and 36, respectively, to which a crossbar 38 is suitably connected, for example, by bolts. As best seen in FIG. 2, a pair of rods 40 and 42 interconnect the opposed end edges of crossbars 38 at opposite ends of frame 12. More particularly, the end of each rod 40 is threaded at 44 (FIG. 3) and a pair of lock nuts 46, together with a washer, adjustably secure the rod 40 to the crossbar 38 at one end of the frame 12. With reference to FIGS. 1 and 2, the opposite end of each rod 40 connects with one end of a tension spring 48, the opposite end of the tension spring being connected to the interior end of rod 42. The opposite end of each rod 42 is threaded and bolted to the corresponding end of crossbar 38. As best seen in FIGS. 3 and 4, each of the lower ends of spaced elements 30 and 32 of arms 24 and 26 are provided with a track or slot 50 for releasably receiving a clamping mechanism C, which will now be described.

Clamping mechanism C comprises a pair of jaws 52 and 54 releasably secured one to the other, for example, by bolts 56 whereby the jaws can be moved toward and away from one another. As illustrated in FIG. 5, jaws 52 and 54 are generally L-shaped in cross-section, and are disposed in opposition one to the other. The opposed legs of the jaws define a space therebetween for receiving a pair of ceramic insulating blocks 58 and 60, respectively. A pair of pins 62 and 64, respectively, mount the insulator blocks 58 and 60 between the jaws. Thus, an end of a substrate may be inserted between blocks 58 and 60 and the jaws moved toward one another by action of bolts 56 to clamp the substrate end therebetween.

A pin 66 extends through jaws 52 and 54 in a region thereof spaced from blocks 58 and 60 and projects beyond the side faces of the clamp. Pin 66 is releasably receivable in the slots 50 in elements 30 and 32. The clamps are therefore connected to arms 24 and 26 essentially by a single central pivotal contact.

Figure 6:
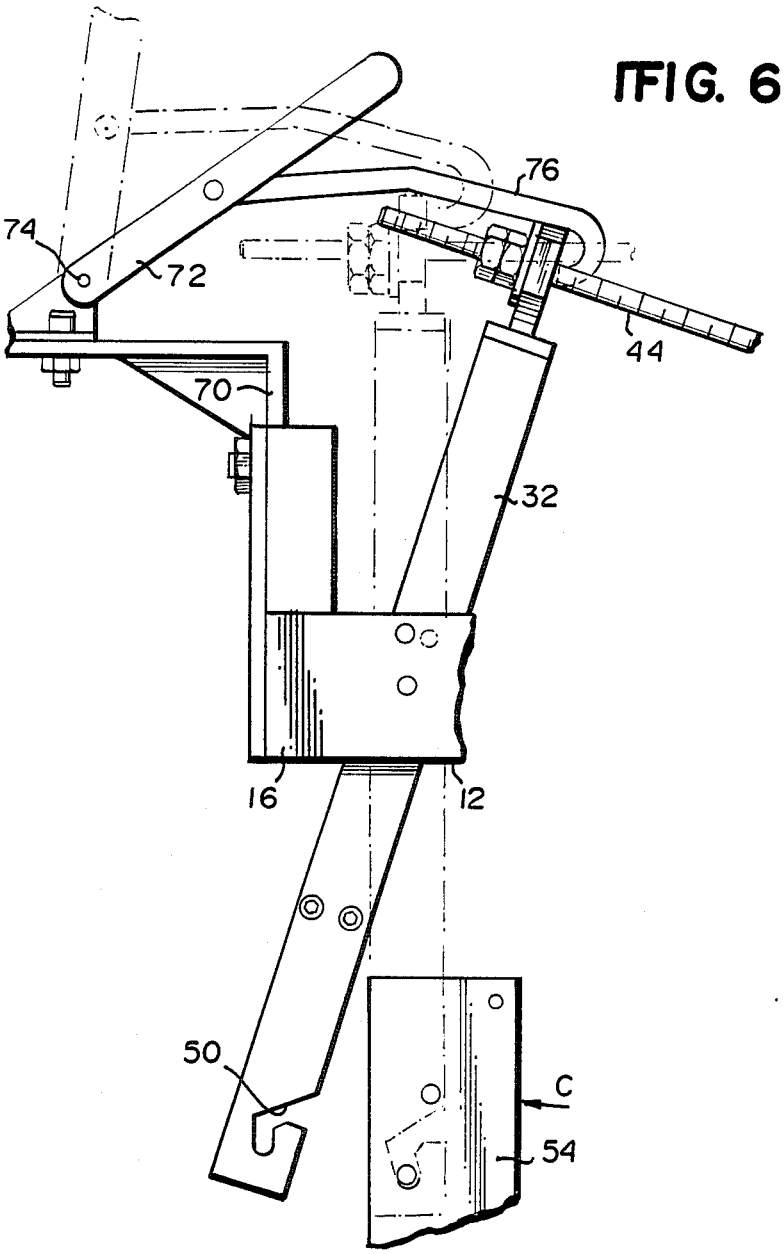
FIG. 6 is a view similar to FIG. 3 illustrating the pivotal arm of the tensioning mechanism in an exaggerated relaxed position prior to engaging the substrate.

For reasons hereinafter disclosed, a support bracket is mounted at one end of frame 12 and carries a lever 72 for pivotal movement about a pivot 74. Lever 72 constitutes an over-center or toggle clamp and has a hook 76 pivotally carried intermediate its length. It will be appreciated from a review of FIGS. 3 and 6 that movement of lever 72 in a counterclockwise direction causes hook 76 to engage crossbar 38. Further pivoting action of lever 72 causes hook 76 to pivot arm 24 in a counterclockwise direction against the bias of tension springs 48. Release of hook 76 from crossbar 38 enables tension springs 48 to pivot arm 24 in a reverse or clockwise direction, as illustrated in FIG. 3. When the substrate is disengaged from the tension mechanism and the springs 48 have rotated arm 24 to the full line position illustrated in FIG. 6, it will be seen that a pair of openings in the frame and arm 24, respectively, lie in misalignment, one with the other. Upon tensioning springs 48 by movement of lever 72, these openings can be brought into alignment when the arm is in the position substantially as illustrated in FIG. 3, whereby a pin may be inserted through the registering openings to lock arm 24 in that position. Thus, prior to use, the arm 24 lies canted by springs 48 in the full line position illustrated in FIG. 6.

In use, lever arm 72 is rotated to engage hook 76 with crossbar 38. Lever arm 72 is then pulled back to rotate arm 24 in a generally counterclockwise direction, as illustrated in FIG. 3, into a substantially vertical orientation wherein the distance between the lower ends of the arms is such that the substrate, when the clamps are secured to its opposite ends, may be attached to the arms by disposing pins 66 in slots 50. Thus, lever 72 is used to rotate arm 24 into the position illustrated in FIG. 3 against the bias of springs 48. The clamps C, which are separate from the arm, are clamped about the ends of the substrate with the insulator blocks disposed between the substrate and the jaws. With the opposite ends of the substrate disposed within the clamps and the arm 24 lying in the full line and dashed line positions illustrated in FIGS. 3 and 6, respectively, pins 66 carried by clamps C are inserted into slot 50, whereby the clamps are carried by the respective arms, with the substrate extending therebetween. Release of the lever 72, for example by rotating it past its over-center position to disengage hook 76 from crossbar 38, enables tension spring 48 to rotate arm 24, for example in a clockwise direction illustrated in FIG. 3, to tension the substrate. The tension applied to arm 24, in turn, displaces the lower clamp carried thereby in a direction away from the clamp at the opposite end of the frame whereby the substrate is placed under tension. The single pivotal point of contact between the clamp and the arm at each end of the tensioning mechanism affords a uniformity of tension across the width of the substrate.

To ensure that the substrate is plated to a uniform thickness, a trial-and-error approach is afforded. Particularly, electrical leads 80 (FIG. 7) are welded at 82 along substrates, for example every four inches, for connection to a current controller I.E. which regulates the current flow through each wire when substrate S is disposed in the electrolytic bath B. That is, the current flow to the various portions of substrate S defined by the electrical connections thereto can be selected to afford more or less plating to achieve the correct hole size. Thus, in use, the tensioning mechanism with a tensioned substrate and electrical connections is disposed in the electrolytic bath B and current applied. With the substrate serving as a cathode, ions migrate toward the cathode to provide the nickel phosphorus plating. The tensioning mechanism and substrate S are then removed from the bath and orifices are formed in the substrate by treating it with ferric chloride in the manner set forth in the above-identified patent. Because hole size is a function of the plating thickness, the correct hole size may be determined by applying a predetermined plate thickness along the plate. Thus, once it has been determined what areas of the plate do not have the correct hole size, the current controller can be adjusted to increase or decrease the current flow to selected areas of a plate to thereby increase or decrease the plate thickness, as necessary. Thus, after trial and error on different substrates disposed in the electrolytic bath, the appropriate current at each longitudinal position along the substrate may be determined. Once determined, substrates may be electroplated, using the tensioning apparatus described herein, to the proper thickness, thereby ensuring accuracy of the hole size in a consistent and reproducible manner.

Figure 7:
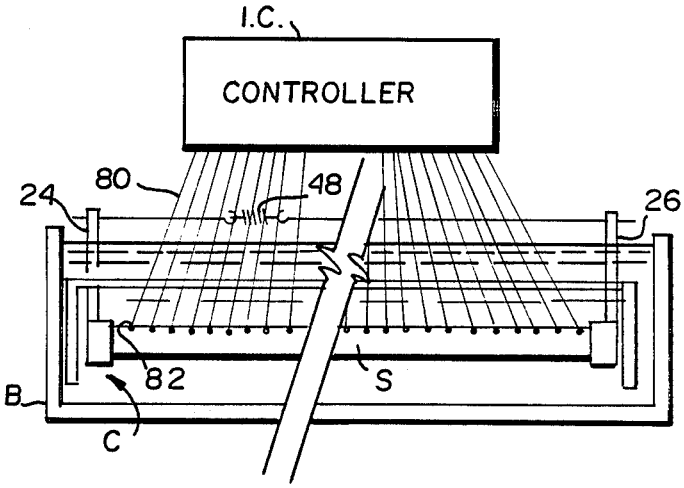
FIG. 7 is a schematic view illustrating the tensioning mechanism hereof disposed in an electrolytic bath.

It will be appreciated that the tensioning mechanism assures flatness and planarity of the substrate disposed between the clamps. When the tensioning mechanism is disposed in the bath, a fixture, not shown, locates the mechanism and substrate a predetermined distance from the anode in the bath. Also, to ensure that the electrolytic bath itself, due to its high temperature and corrosive nature, does not distort, warp or otherwise effect movement of the substrate while tensioned in the frame, the frame, arms and clamps (excluding the ceramic blocks) are formed of titanium. In this manner, the effects of high temperature on different materials, as well as the corrosive effects of the bath on the tensioning mechanism, which would otherwise tend to distort or warp the frame in the bath, are eliminated. The springs 48 and rods associated therewith need not be formed of titanium and may be formed of other materials, such as steel, inasmuch as they are maintained outside the bath, as illustrated in FIG. 7. Thus, uniformity and reproducibility of the plating process is achieved for each substrate.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Apparatus for tensioning an elongated substrate for maintaining planarity thereof during an electroplating process to ensure substantially uniform plating, comprising:

a pair of means for gripping opposite end portions of the substrate;

means connected to one of said gripping means for applying tension to the substrate; and means for electrically isolating said tension applying means from the substrate.

2. Apparatus according to claim 1 wherein said gripping means, said tension applying means and said electrical isolating means form part of a unitary portable assembly whereby the assembly, with the tensioned substrate carried thereby, may be disposed in and removed from an electrolytic bath.

3. Apparatus according to claim 1 including electrical connections at spaced intervals along the length of the substrate and means for connecting said electrical connections to the substrate at spaced intervals therealong.

4. Apparatus according to claim 1 wherein the substrate has length, width and depth dimensions, said tension applying means including means for applying tension to the substrate substantially uniformly along the width of the substrate in a direction normal to its length and depth dimensions.

5. Apparatus according to claim 1 wherein said gripping means and said tension applying means are formed of materials which do not substantially affect the tension applied to the substrate when the materials are exposed to the high temperature conditions of an electrolytic bath.

6. Apparatus according to claim 5 wherein said materials include titanium.

7. Apparatus according to claim 1 wherein the substrate has length, width and depth dimensions, said gripping means, said tension applying means and said electrical isolating means forming part of a unitary portable assembly whereby the assembly, with the tensioned substrate carried thereby, may be disposed in and removed from an electrolytic bath, electrical connections at spaced intervals along the length of the substrate and means for connecting said electrical connections to the substrate at spaced intervals therealong, said tension applying means including means for applying tension to the substrate substantially uniformly along the width of the substrate in a direction normal to its length and depth dimensions, said gripping means and said tension applying means being formed of materials which do not substantially affect the tension applied to the substrate when the materials are exposed to the high temperature conditions of an electrolytic bath, said materials including titanium.

8. Apparatus for tensioning an elongated substrate for maintaining planarity thereof during an electroplating process to ensure substantially uniform plating, comprising:

an elongated frame;

at least one arm pivotally carried by said frame at one end thereof;

a pair of clamps for gripping the opposite ends of the substrate, one of said clamps being carried by said one arm with the other of said clamps being carried by said frame adjacent the opposite end thereof;

means for electrically isolating said one arm and said frame from the substrate when the substrate is clamped between said arms; and means carried by said frame for pivoting said one arm in a direction to apply tension to the substrate.

9. Apparatus according to claim 8 wherein at least one of said clamps includes a pair of jaws with one of said jaws movable toward and away from the other jaw, said electrical isolating means including electrical insulating material between said jaws and the end of the substrate.

10. Apparatus according to claim 9 wherein said insulating material comprises a pair of insulating blocks formed of a ceramic material and disposed on opposite sides of the substrate end.

11. Apparatus according to claim 8 wherein said pivoting means includes spring means connected to said one arm at a location spaced from its pivot and to said frame.

12. Apparatus according to claim 8 including a second arm carried by said frame at its opposite end and carrying the other of said clamps, said pivoting means including spring means connected at opposite ends to said arms for biasing said one arm for pivotal movement in said tension applying direction.

13. Apparatus according to claim 12 wherein said spring means is connected to said one arm on the side thereof remote from its pivotal connection with said frame.

14. Apparatus according to claim 8 including means for releasably securing said one clamp and said one arm one to the other.

15. Apparatus according to claim 14 wherein said releasably securing means includes a pivotal connection between said one arm and said one clamp whereby the tension forces applied to said substrate are distributed substantially uniformly over the width of the substrate.

16. Apparatus according to claim 15 wherein said one arm has means defining a slot, said one clamp including a pair of jaws with one of said jaws being movable toward and away from the other of said jaws, and a pin carried by said jaws for engagement in said slot.

17. Apparatus according to claim 11 including means carried by said frame for moving said one arm against the bias of said spring.

18. Apparatus according to claim 17 including a second arm carried by said frame at the opposite end thereof and carrying the other of said clamps, said pivoting means including spring means connected at opposite ends to said arms biasing said one arm for pivotal movement in said tension applying direction, said spring means being connected to said one arm on the side thereof remote from its pivotal connection with said frame.

19. Apparatus according to claim 8 wherein at least portions of said one arm adjacent said one clamp are formed of titanium.

20. Apparatus according to claim 12 wherein at least portions of said arms adjacent the clamps and said frame are formed of titanium.

21. Apparatus according to claim 8 including electrical connections at spaced intervals along the length of the substrate and means for connecting said electrical connections to the substrate at spaced intervals therealong.

22. Apparatus for tensioning an elongated substrate for maintaining planarity thereof during an electroplating process to ensure substantially uniform plating, the substrate having length, width and depth dimensions, comprising:

a pair of means for gripping opposite end portions of the substrate; and means connected to one of said gripping means for applying tension to the substrate substantially uniformly along the width of the substrate in a direction normal to its length and depth dimensions.

23. Apparatus according to claim 22 wherein said gripping means and said tension applying means are formed of materials which do not substantially affect the tension applied to the substrate when the materials are exposed to the high temperature conditions of an electrolytic bath.

* * * * *